US005957355A

United States Patent [19]

Swetish

[11] Patent Number: 5,957,355

[45] Date of Patent: Sep. 28, 1999

[54] PACK COMPRESSION SYSTEM

[75] Inventor: Thomas R. Swetish, Racine, Wis.

[73] Assignee: Johnson Worldwide Associates, Sturtevant, Wis.

[21] Appl. No.: 08/990,139

[22] Filed: Dec. 12, 1997

[51] Int. Cl.[6] ..... A45F 3/04

[52] U.S. Cl. ..... 224/627; 224/628; 224/650

[58] Field of Search ..... 224/650, 201, 224/600, 625, 627, 628, 629, 633, 636, 637, 638, 639, 647, 648, 660, 681, 682, 259, 262, 328; 383/2; 190/112, 103

[56] References Cited

U.S. PATENT DOCUMENTS

| | | | |
|---|---|---|---|
| D. 339,225 | 9/1993 | Zel . | |
| 2,407,787 | 9/1946 | Kernahan . | |
| 2,792,980 | 5/1957 | Brown . | |
| 3,563,431 | 2/1971 | Pletz . | |
| 3,797,718 | 3/1974 | Plant . | |
| 4,331,272 | 5/1982 | Ward . | |
| 4,491,258 | 1/1985 | Jones . | |
| 4,655,343 | 4/1987 | Lane et al. . | |
| 4,752,263 | 6/1988 | Pritchard et al. . | |
| 4,805,749 | 2/1989 | Gerch | 190/111 |
| 4,844,307 | 7/1989 | Rutledge . | |
| 4,884,731 | 12/1989 | Sibley | 383/2 |
| 5,114,059 | 5/1992 | Thatcher . | |
| 5,125,547 | 6/1992 | Russell . | |
| 5,240,159 | 8/1993 | Gregory . | |
| 5,538,169 | 7/1996 | Moore | 224/328 |
| 5,570,824 | 11/1996 | Lyon et al. . | |

*Primary Examiner*—Allan N. Shoap
*Assistant Examiner*—Maerene W. Brevard
*Attorney, Agent, or Firm*—Foley & Lardner

[57] ABSTRACT

A pack compression system includes a pack enclosing an internal volume, a closing mechanism, and first and second compression mechanisms. The pack has a top, a bottom, a back panel extending between the top and bottom, an adapter for being positioned proximate the user's back, and a front panel opposite the back panel. The front panel includes an opening longitudinally extending between the top and the bottom to access the internal volume. The closing mechanism selectively closes the opening, the first and second compression mechanisms coupled to the pack on opposite lateral sides of the opening. Each compression mechanism extends from a first location proximate the back panel across the first opening to a second location proximate the back panel to compress the internal volume of the pack.

32 Claims, 6 Drawing Sheets

FIG. 1
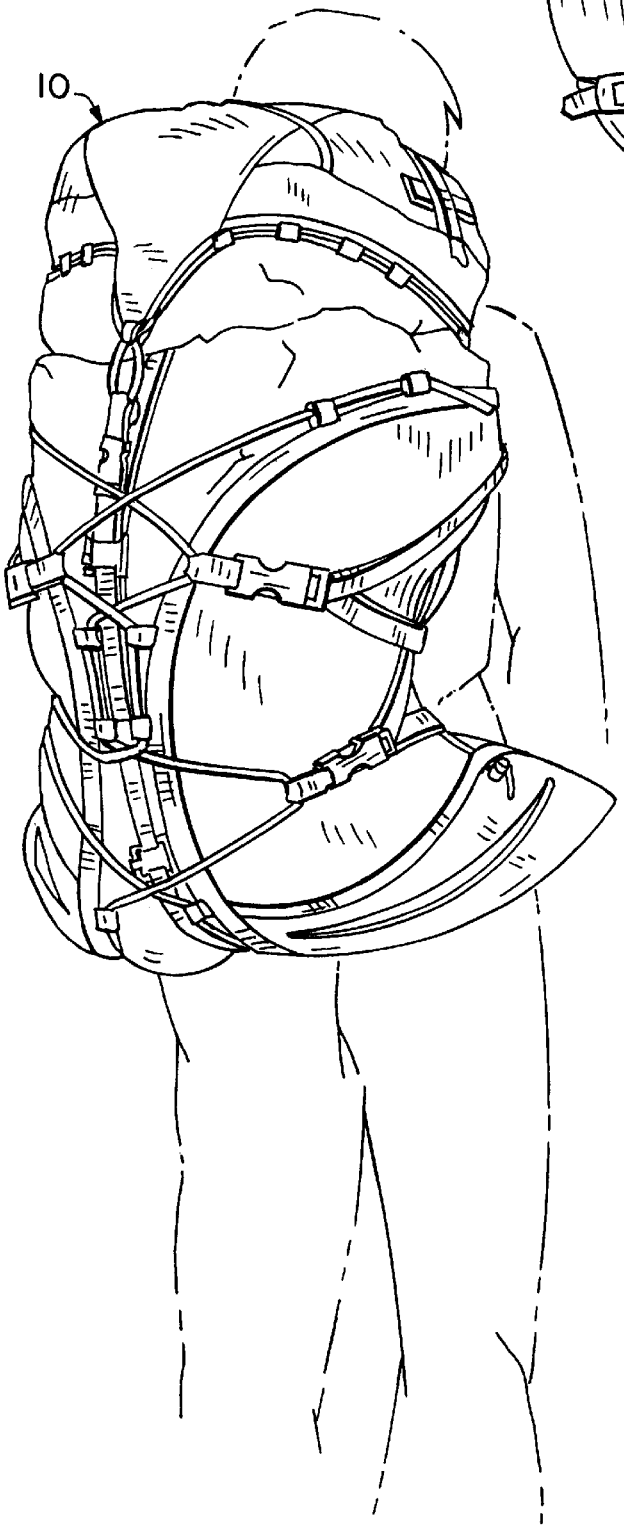
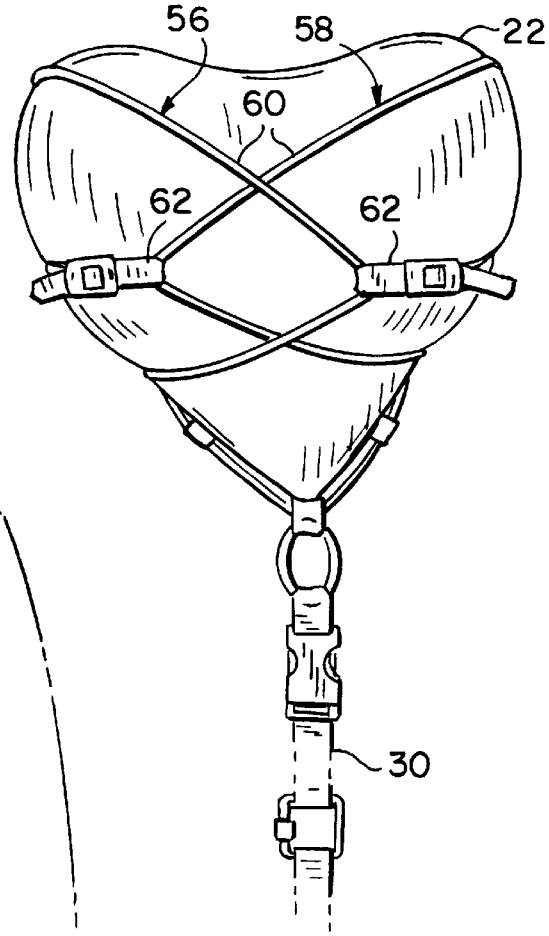
FIG. 5

PACK COMPRESSION SYSTEM

FIELD OF THE INVENTION

The present invention relates generally to packs, such as packs for camping, hiking, and trekking. In particular, the present invention relates to a pack compression system for loading, accessing and compressing items within internal an volume of the pack.

BACKGROUND OF THE INVENTION

Packs, such as back packs, are well-known and are used for storing and carrying a wide-range of objects during such activities as camping, hiking and trekking. Packs typically include a plurality of panels which define an internal storage volume. The internal storage volume is typically accessed through a top opening (hereinafter referred to as a top-loading pack), through an opening extending around and along a side of the pack (hereinafter referred to as a side-loading pack), or through an opening extending along a front panel of the pack opposite the user's back (hereinafter referred to as a panel-loading pack). The openings of each of the top-loading pack, side-loading pack and panel-loading packs are conventionally closed by a zipper mechanism. In situations where the pack is over-filled, the zipper mechanism closing the openings frequently fail as a result of the stress placed upon the zipper mechanism.

Top-loading packs require the user to load the internal storage volume through an opening defined on a top of the pack. As a result, objects loaded into the internal storage volume tend to settle towards the bottom of the pack in misalignment with the pack's center of gravity. Because the objects stored in the internal storage volume are loaded from the bottom up, it is often extremely difficult to access those objects stored at the bottom of the pack's internal storage volume.

To provide improved accessibility to objects stored in the pack, panel-loading packs and side-loading packs have been developed. Although panel loading packs provide improved accessibility as compared to top-loading packs, the size of the openings of panel loading packs must be kept relatively small to minimize the stress placed upon the zipper mechanism when the pack is overfilled to prevent the zipper failure. As a result, panel loading packs still fail to provide complete access to the internal storage volume along the longitudinal length of the pack.

With side-loading packs, the entire front panel as well as a portion of the side panels of the pack are opened away from the back panel to access the entire length of the pack. As compared to top and panel loading packs, side-loading packs place even greater stress on the zipper mechanisms. Because the zipper mechanisms extends along the sides of the pack, the forces due to over-packing of items between the front panel and the back panel are transferred directly to the zipper extending along the sides of the pack. As a result, the zipper mechanisms of side-loading packs are even more difficult to close, and are even more susceptible to failure. Thus, over-filling the pack often results in the zipper mechanisms failing. At the same time, if the packs are not filled to capacity, loosely packed items in the internal storage volume will once again settle towards the bottom in misalignment with the user's center of gravity.

To prevent the settling of items within the internal storage volume, many side-loading and panel-loading packs are additionally provided with compression straps or compression mechanisms to compress and hold the items in place within the internal storage volume of the pack. These compression straps typically extend between the front and back and along opposite sides of the pack to compress the front panel perpendicularly towards the back panel of the pack. Although the compression straps or mechanisms may prevent items from settling towards the bottom of the pack, the compression straps pull opposite sides of the zipper mechanisms away from one another to increase the stress on the zipper and correspondingly increase the probability of the zipper failing. In addition, the compression straps do not inwardly compress the sides of the pack toward the centerline of the pack.

As a result, there is a continuing need for a pack having an internal storage volume that is completely accessible, that can be easily closed when full, and that can be fully compressed without increasing stress on the mechanisms used to close the internal storage volume of the pack.

SUMMARY OF THE INVENTION

The present invention is directed to a pack compression system including a pack enclosing an internal volume, a closing mechanism, and first and second compression mechanisms. The pack has a top, a bottom, a back panel extending between the top and bottom and adapted for being positioned proximate the user's back, and a front panel opposite the back panel. The front panel includes an opening longitudinally extending between the top and the bottom to access the internal volume. The closing mechanism selectively closes the opening. The first and second compression mechanisms are coupled to the pack on opposite lateral sides of the opening. Each compression mechanism extends from a first location proximate the back panel across the first opening to a second location proximate the back panel to compress the internal volume of the pack.

In one exemplary embodiment of the pack compression system, the first and second compression mechanisms include first and second side panels extending between the front and the back and first and second compression straps connected to the first and second panels. In one embodiment, the first and second panels define the internal storage volume. Alternatively, other panels extending between the front and the back may be used to define the internal storage volume while the first and second panels merely act to compress the panels of the pack and the internal storage volume.

In one exemplary embodiment, the first and second panels have a rigid perimeter. Preferably, the panels include a rigid mechanism extending along the perimeter. In the exemplary embodiment, the first and second compressions straps are coupled along the perimeter of each panel at a plurality of locations. In the preferred embodiment, each of the first and second panels is semicircular in shape. The present invention is further directed to a pack compression system including a pack enclosing an internal volume and an opening to access the internal volume. The first panel extends between the top and the bottom along a first side of the internal volume. The first panel is coupled proximate to the back panel and extends towards the front panel. The second panel extends between the top and the bottom along a second side of the internal volume. The second panel is coupled proximate to the back panel and extends towards the front panel. The first compression mechanism is coupled to a perimeter of the first panel and is configured for being releasibly coupled to the pack proximate the back panel and the second side of the internal volume to compress the first panel over the internal volume and towards the second side of the internal volume. The second compression mechanism is coupled to a perimeter of the second panel and is configured for being releasibly coupled proximate the back panel in the first side of the internal volume to compress the second panel over the front panel and towards the first side of the internal volume.

The present invention is also directed to pack compression system including a pack enclosing an internal volume, first and second spaced connector points at first and second locations on the pack, a first compression mechanism having a connector. The first compression mechanism has first and second spaced portions. The first portion is secured to a third location on the pack. The connector is secured to the second portion of the compression mechanism. The connector is configured for releasibly connecting the second portion to either of the first and second connector points to adjust compression of the internal volume by the compression mechanism.

BRIEF DESCRIPTION OF THE DRAWINGS

FIG. 1 is a front perspective view of a pack compression system having a main pack and an auxiliary pack supported on a user's back.

FIG. 5 is a top elevational view of the auxiliary pack.

DETAILED DESCRIPTION OF THE PREFERRED EMBODIMENT

Figure 2:
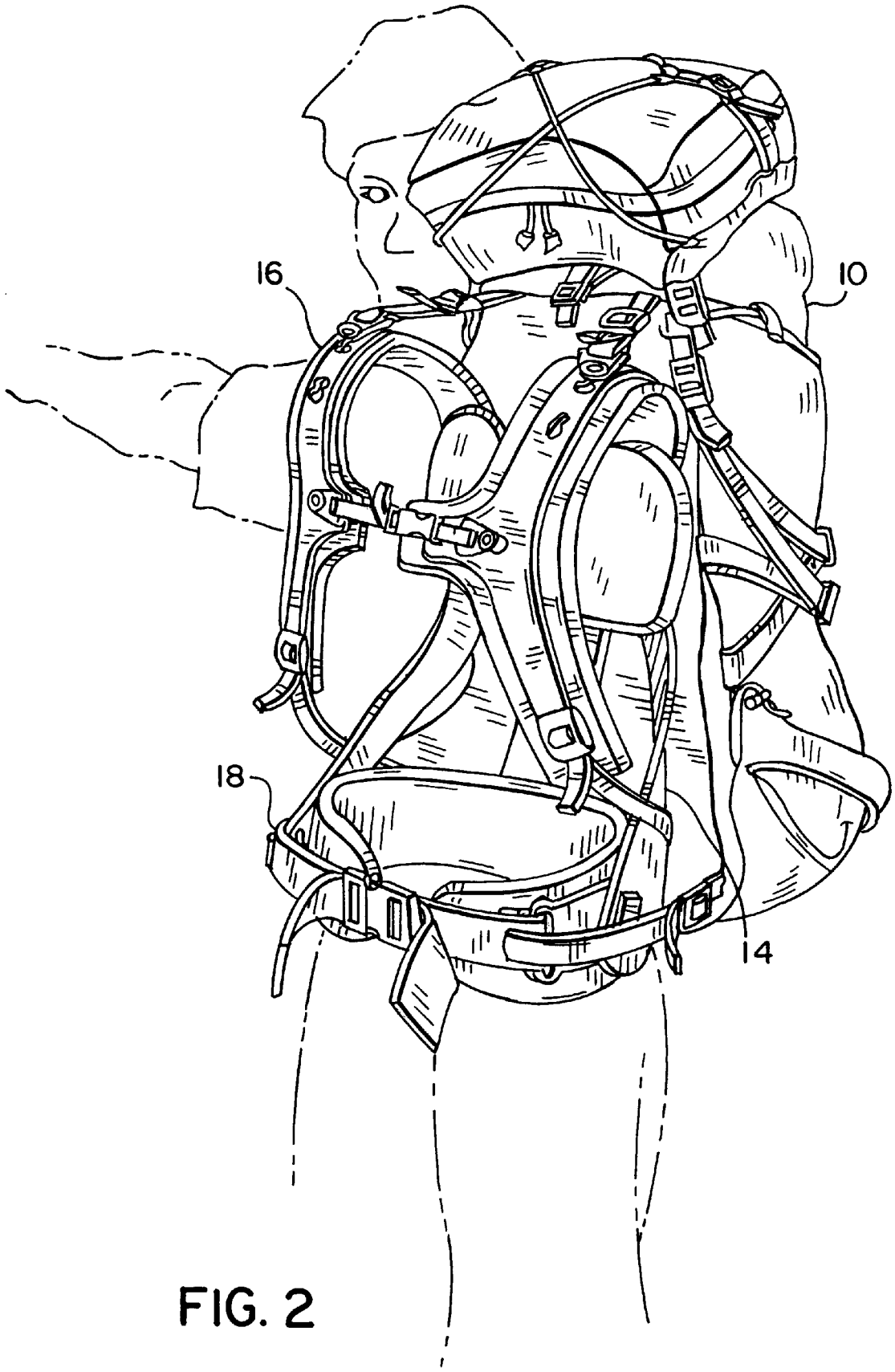
FIG. 2 is a rear perspective view of the pack compression system supported on a user's back.

FIGS. 1 and 2 are perspective views of a pack compression system 10 supported upon a user's back by a frame 14, a shoulder support assembly 16 and a belt assembly 18. Frame 14, shoulder support assembly 16 and belt assembly 18 are described in greater detail in co-pending U.S. patent applications Ser. No. 08/669,752, entitled "Interchangeable Load Carrying System" and filed on Jun. 26, 1996; Ser. No. 08/670,586, entitled "Quick-Release Pin Latch Assembly" and filed on Jun. 26, 1996; Ser. No. 08/673,742, entitled "Flexible Frame Load Carrying System" and filed on Jun. 26, 1996; Ser. No. 08/762,569, entitled "Belt Assembly for a Load Carrying System" and filed on Dec. 9, 1996; and Ser. No. 08/762,607, entitled "Shoulder Support Structure Frame Load Carrying System" and filed on Dec. 9, 1996, herein incorporated by reference. Although pack compression system 10 is illustrated as being supported upon the user's back by frame 14, shoulder support assembly 16 and belt assembly 18, pack compression system 10 may alternatively be supported on the user's back by a variety of other alternative support structures used to support a pack on the user's back. Moreover, pack compression system 10 may alternatively be configured so as to be supported on the user's back without the assistance of separate support structures.

Figure 4:
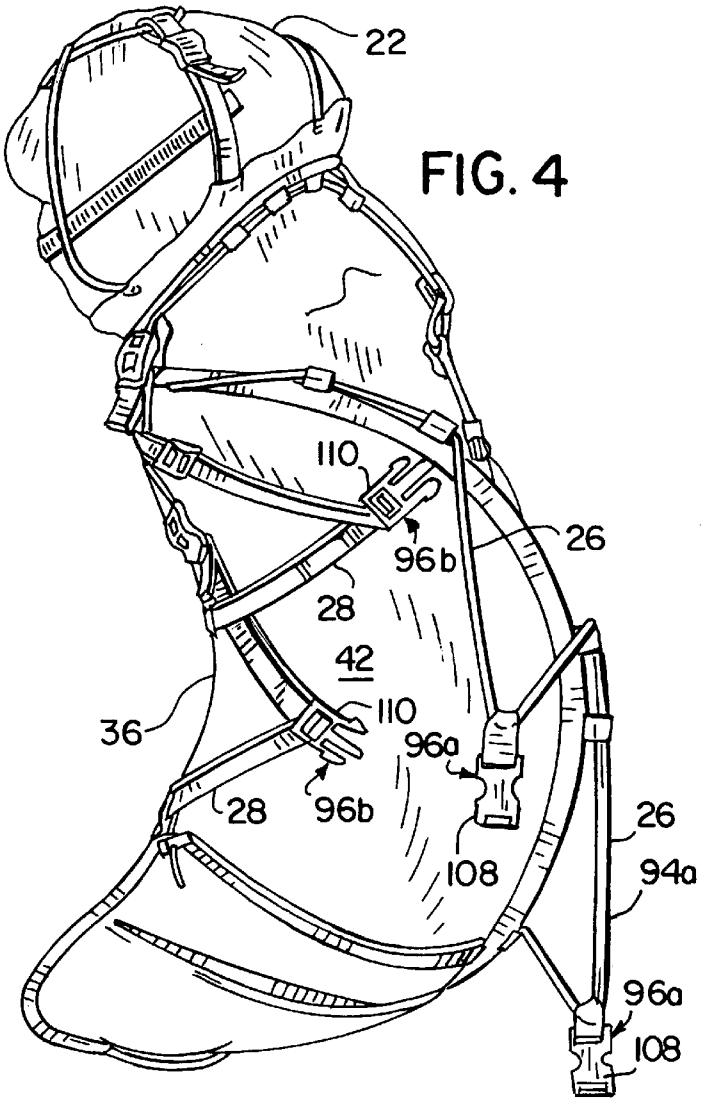
FIG. 4 is a side elevational view of the pack compression system of FIG. 3.
Figure 3:
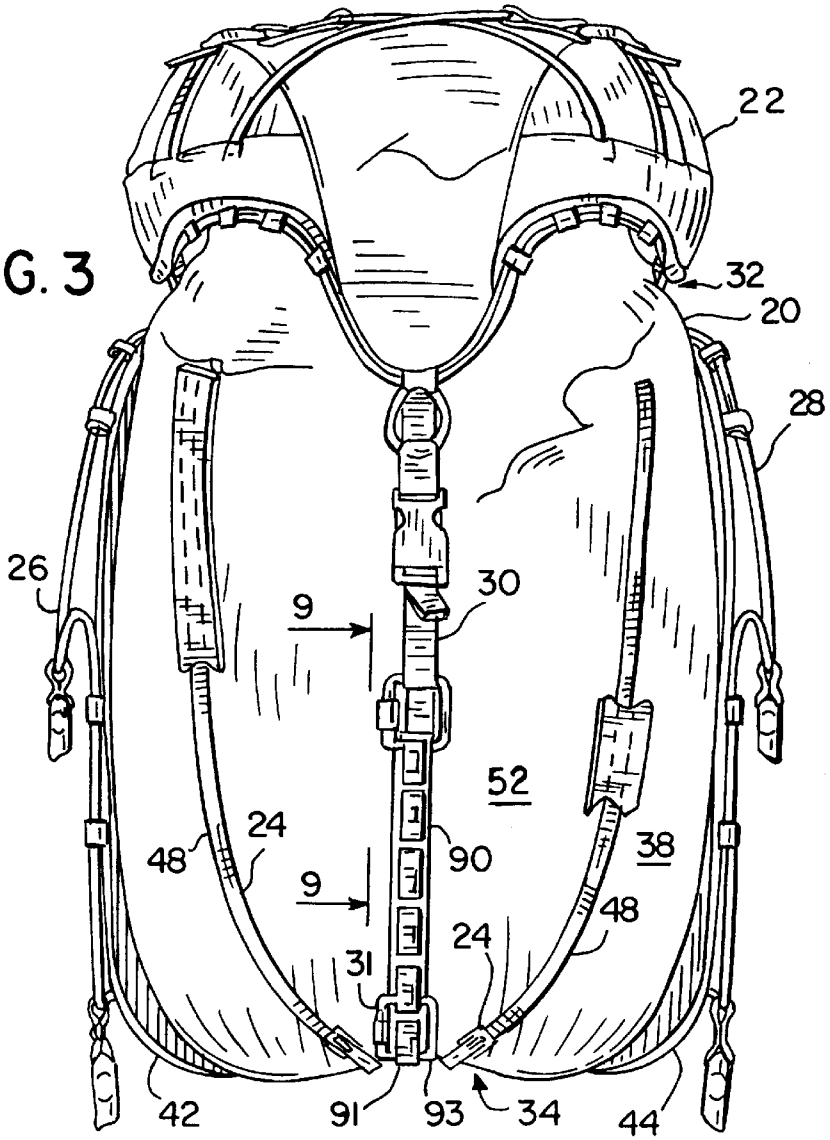
FIG. 3 is a front elevational view of the pack compression system with the main pack in an uncompressed state.

As best shown by FIGS. 3 and 4, pack compression system 10, generally includes main pack 20, auxiliary pack 22, closing mechanisms 24 and compression mechanisms 26, 28, 30 and 31. Main pack 20 has a top 32 and a bottom 34, and generally includes back panel 36, front panel 38 and side panels 42, 44. Back panel 36 extends between top 32 and bottom 34 and is configured for being positioned proximate the user's back. Front panel 38 extends between top 32 and bottom 34 opposite back panel 36. Side panels 42, 44 extend between back panel 36 and front panel 38 while spacing back panel 36 from front panel 38. Panels 36, 38, 42 and 44 preferably comprise individual panels which are sewn together. Alternatively, panels 36, 38, 42 and 44 may be secured to one another by various other attachment methods or may be formed by deforming, creasing or folding larger sheets or panels to form panels 36, 38, 42 and 44 in conjunction with one another. Because side panels 42 and 44 have perimeters that are arcuate in shape, front panel 38 extends adjacent to back panel 36 at both the top 32 and bottom 34 of main pack 20. As a result, the largest volume of main pack 20 is centered between top 32 and bottom 34 at the pack's center of gravity. Back panel 36, front panel 38 and side panels 42, 44 define an internal storage volume of main pack 20.

Figure 6:
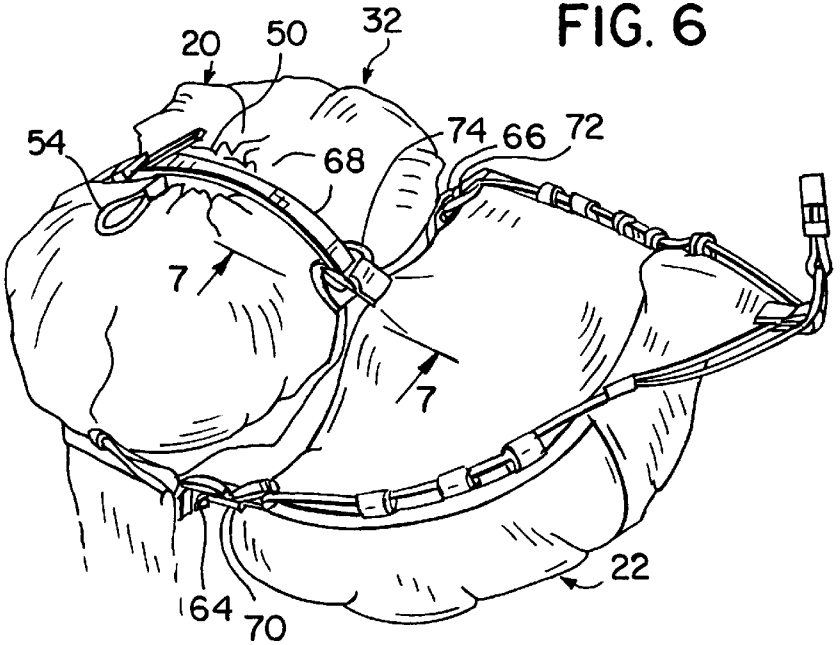
FIG. 6 is a perspective view of the auxiliary pack pivoted away from the main pack of the pack compression system.
Figure 8:
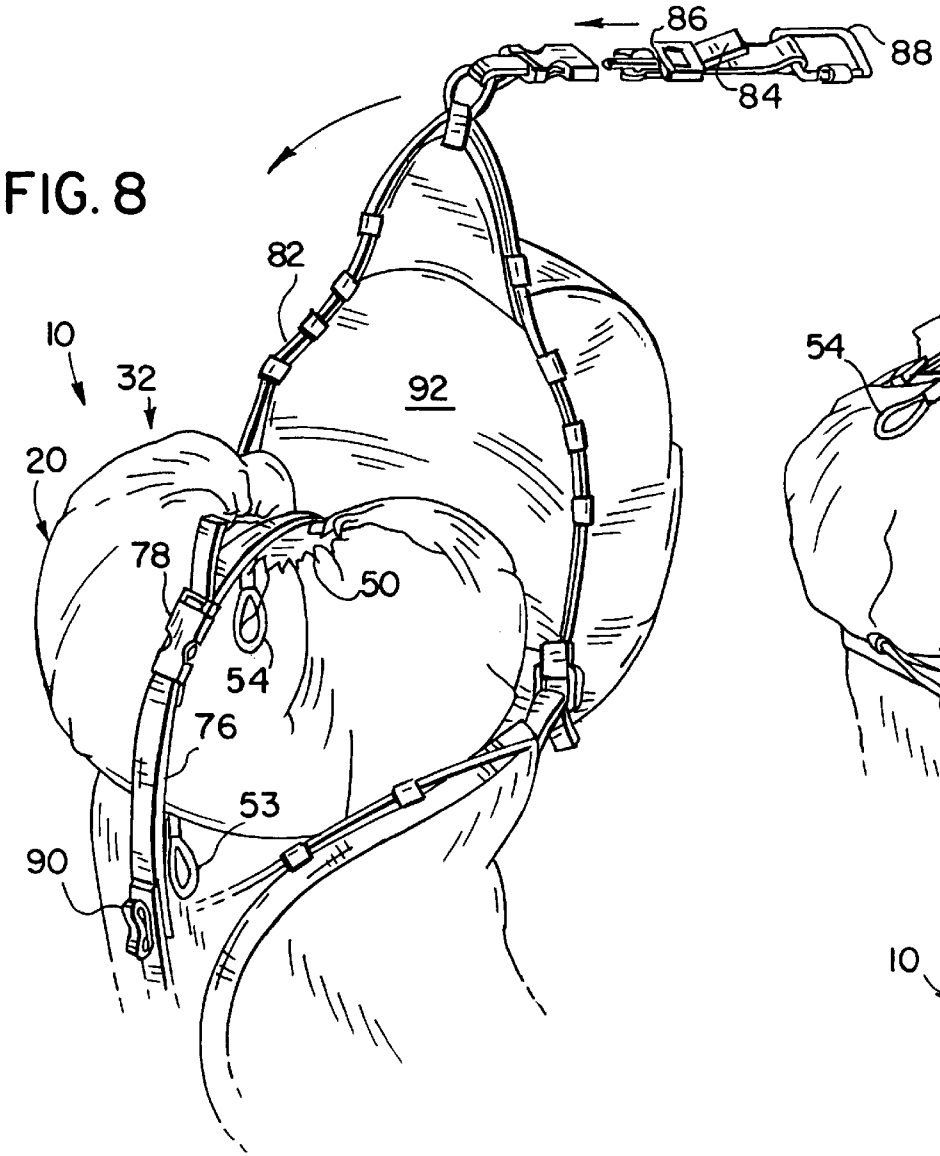
FIG. 8 is a fragmentary perspective view of the pack compression system with the auxiliary pack pivoted away from the main pack.

To provide access to the internal storage volume of main pack 20, front panel 38 includes main opening 48 and top opening 50 (shown in FIGS. 6 and 8). Main opening 48 longitudinally extends between top 32 and bottom 34 through front panel 38 opposite back panel 36. As best shown by FIG. 3, main opening 48 is preferably V-shaped with a corresponding V-shaped door or flap 52 formed as part of front panel 38. As a result, flap 52 may be pivoted to open main opening 48 whereby the user may view and access the entire interior storage volume of main pack 20. At the same time, because opening 48 is formed within front panel 38 opposite back panel 36, overfilling of the interior storage volume of main pack 20 between back panel 36 and front panel 38 does not exert stress directly on closing mechanisms 24. Consequently, opening 48 is easier to close and the useful lives of closing mechanisms 24 are prolonged. As shown by FIG. 3, closing mechanisms 24 preferably comprise a pair of zippers which release flap 52 from the remainder of front panel 38 as the zippers are pulled towards top 32. In lieu of zippers, closing mechanisms 24 may comprise other well-known fastening or closing arrangements.

As best shown by FIGS. 6 and 8, front panel 38 extends adjacent to back panel 36 at top 32 of main pack 20 below top opening 50. Front panel 38 includes a drawstring 53 sewn within and about opening 50. Tightening of drawstring 53 draws portions of front panel 36 together below opening 50 to divide the interior storage volume of main pack 20 into two separate compartments for separating items.

Alternatively, drawstring 53 may be loosened for complete communication throughout the interior storage volume of main pack 20. As shown by FIGS. 6 and 8, top opening 50 is also opened and closed by a drawstring 54 sewn in and about the perimeter of opening 50.

Compression mechanisms 26, 28, 30 and 31 interact with panels 36, 38, 42, and 44 to compress the contents stored within the internal storage volume of main pack 20. In particular, as described in greater detail with respect to FIGS. 10–15 hereafter, compression mechanisms 26 and 28 extend across opening 48 to compress side panels 42 and 44, respectively, towards a longitudinal center line of main pack 20 and towards back panel 36. Compression mechanisms 30 and 31 compress top 32 and bottom 34, respectively, towards a transverse center line of main pack 20. As a result, the internal storage volume of main pack 20 is symmetrically compressed from opposite longitudinal and lateral sides of opening 48 to prevent items within the internal storage volume form shifting and to maintain the items in alignment with the pack's center of gravity.

FIGS. 5–8 illustrate auxiliary pack 22 in greater detail. Similar to main pack 20, auxiliary pack 22 defines an internal storage volume for storing items. As best shown by FIG. 5, auxiliary pack 22 includes compression mechanisms 56, 58. Compression mechanisms 56 and 58 are substantially identical to one another and compress from opposite directions relative to pack 22. Each of compression mechanisms 56 and 58 includes strap portions 60 and 62. Strap portions 60 are each attached at opposite lower corners of pack 22 and extend partially across a top of pack 22 at which point portions 60 are coupled to strap portions 62. Strap portions 62 are fixedly attached at lower intermediate portions of pack 22 and have an adjustable length. Shortening the length of strap portions 62 pulls the connected strap portions 60 towards the opposite side of pack 22 to compress the contents of pack 22.

Figure 7:
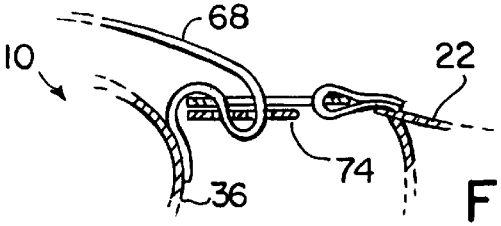
FIG. 7 is a sectional view of the pack compression system of FIG. 6 taken along lines 7—7.

As best shown by FIGS. 6 and 7, auxiliary pack 22 is removably attached to top 32 of main pack 20 by straps 64, 66 and 68. Straps 64 and 66 are located on opposite lateral sides of main pack 20 and attach pack 22 to main pack 20 by ladder locks 70, 72. Straps 68 extends though a ladder lock 74 attached to auxiliary pack 22 and further extends over and across top opening 50 of main pack 20 for being releasibly secured to front panel 38 via strap 76 and adjustable buckle 78. As a result, straps 68, straps 76 and buckle 78 allow the user to adjustably compress top 32 of main pack 20 across top opening 50.

Figure 9:
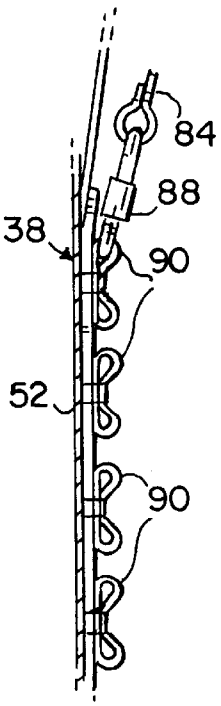
FIG. 9 is a sectional view of the pack compression system of FIG. 3 taken along lines 9—9.
Figure 10:
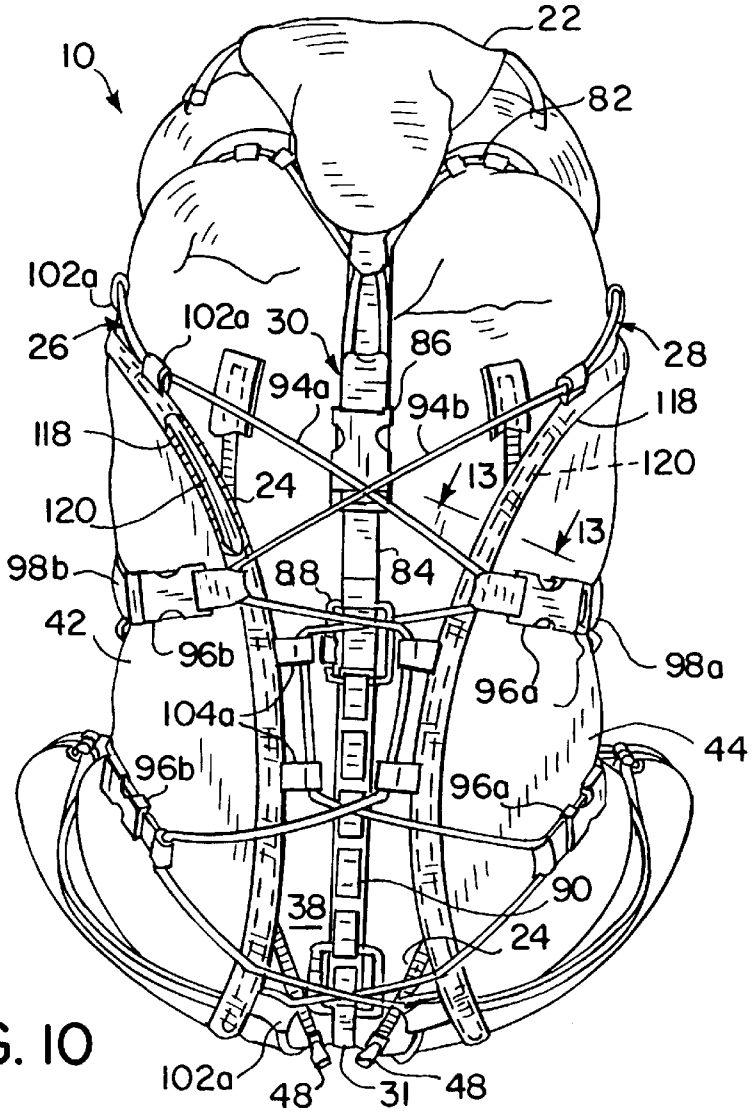
FIG. 10 is a front elevational view of the pack compression system with the main pack in a compressed state.

FIGS. 8, 9 and 10 illustrate compression mechanism 30 in greater detail. As best shown by FIG. 8, compression mechanism 30 includes strap portion 82, strap portion 84, adjustable buckle 86, connector 88 and front panel connector points 90. Strap portion 82 preferably comprises a cord attached along and about a lower perimeter of auxiliary pack 22 and attached to a first portion of buckle 86. Strap portion 84 extends between a second portion of buckle 86 and connector 88. Buckle 86 enables strap portion 84 to be releasibly connected to strap portion 82. Buckle 86 additionally allows the length of strap portion 84 to be adjusted for precise compression adjustment. Connector 88 is secured to strap portion 84 and is configured for attachment to one of the plurality of front panel connectors 90.

As best shown by FIGS. 9 and 10, connectors 90 longitudinally extend between top 32 and bottom 34 along the longitudinal center line of front panel 38. As best shown by FIG. 10, connector 88 may be releasibly connected to any one of the plurality of front panel connector points 90 along front panel 38 to accommodate different volumes of main pack 20 and to adjust the amount of compression applied to top 32 of main pack 20. As shown by FIG. 10, attachment of connector 88 to one of front panel connector points 90 forces a bottom panel 92 of auxiliary pack 22 over and against opening 50 and top 32 of main pack 20. Because strap portion 82 is attached along and about the perimeter of bottom panel 92, the entire area bottom panel 92 is pulled downward against top 32 to compress the internal storage volume. Connector 88 and connector points 90 enable quick, relatively large adjustments of the compression applied by panel 92 of auxiliary pack 22. Because front panel connector points 90 extend along front panel 38, relatively large adjustments of the compression applied by panel 92 may be achieved without the need for corresponding long strap reserve or tail hanging from adjustable buckle 86. At the same time, strap portion 84 and adjustable buckle 86 enable precise, more refined adjustments of the compression applied by panel 92.

In the preferred embodiments illustrated, connector 88 comprises a carabiner while connector points 90 preferably comprise a plurality of loops, preferably in the form of a daisy chain, secured to front panel 38. Alternatively, various other connectors and connector points may be used. Moreover, in lieu of strap portion 84 being releasibly connected to strap portion 82 by a buckle 86, strap portion 84 may be fixedly attached or integrally formed with strap portion 82 with a buckle for adjusting the overall length of strap portion 84.

As best shown by FIG. 3, compression mechanism 31 is similar to compression mechanism 30 and also utilizes front panel connectors points 90. Similar to compression mechanism 30, compression mechanism 31 includes a first strap portion (not shown) attached adjacent back panel 36 of main pack 20 and attached to an adjustable buckle (not shown) similar to adjustable buckle 86. Compression mechanism 31 further includes a second strap portion 91 having one end secured to the adjustable buckle and having a second end secured to connector 93. Connector 93 is essentially identical to connector 88 and is configured for releasible attachment to one of the plurality of front panel connectors 90. As with connector 88 and connector points 90 of compression mechanism 30, connector 93 and connector points 90 of compression mechanism 31 enable quick, relatively large adjustments of the compression of the bottom of main pack 20 without a correspondingly long strap reserve or tail. At the same time, the adjustable buckle (not shown) also enables precise, more refined adjustments to the compression applied to the bottom of main pack 20.

Figure 14:
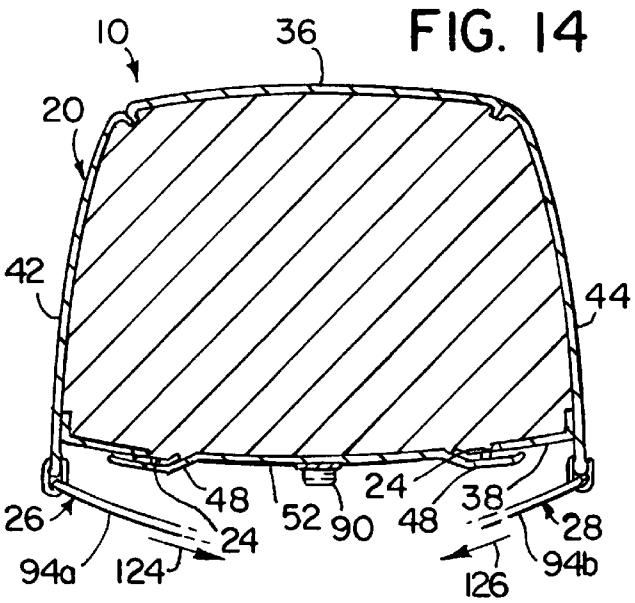
FIG. 14 is a sectional view of the main pack in an uncompressed state.
Figure 15:
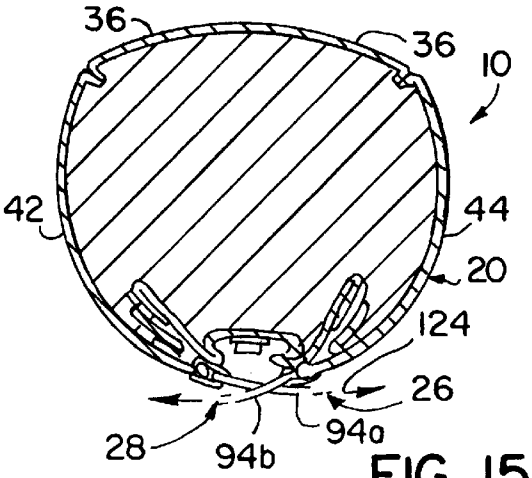
FIG. 15 is a sectional view of the main pack in a compressed state.
Figure 11:
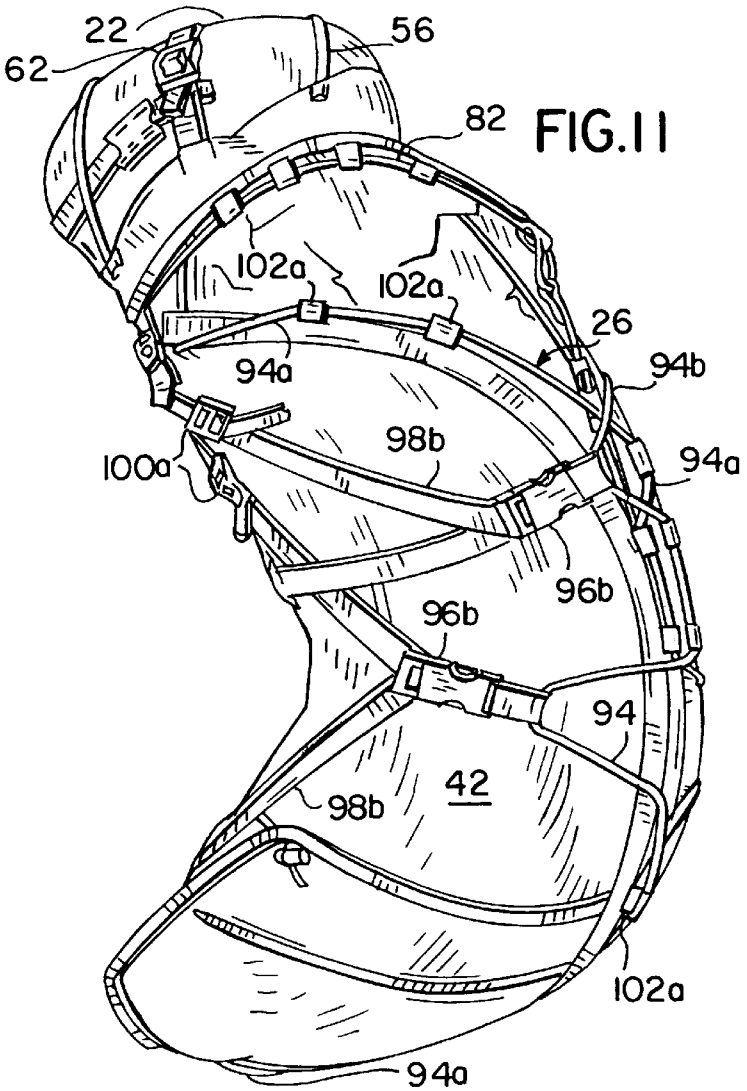
FIG. 11 is a side elevational view of the pack compression system of FIG. 10.

FIGS. 10–15 illustrate compression mechanisms 26 and 28 in greater detail. FIGS. 10, 11 and 15 illustrate compression mechanisms 26 and 28 secured to symmetrically compress the internal storage volume of main pack 20. As best shown by FIGS. 10 and 11, compression mechanisms 26 and 28 generally include strap portions 94*a*, 94*b*, connectors 96*a*, 96*b*, strap portions 98*a*, 98*b* and connectors 100*a*, 100*b*, respectively. Strap portion 94*a* is an elongate flexible mechanism having opposite ends fixedly attached to main pack 20 proximate top 32 and bottom 34 and adjacent to back panel 36 of main pack 20. Strap portion 94*a* is slidably attached to and along the perimeter of side panel 42 via sleeves 102*a* and is fixedly attached to and along the perimeter of side panel 42 via sleeves 104*a* at a midpoint of side panel 42. Strap portion 94*a* is further slidably attached to adjustable connectors 96*a* on opposite sides of sleeves 104*a* between sleeves 104*a* and adjacent sleeves 102*a*. Strap portion 94*b* is identical to strap portion 94*a* except that strap portion 94*b* is secured to and along the perimeter of side panel 44 instead of side panel 42.

Connectors 96*a*, 96*b* are coupled between strap portions 94*a*, 94*b* and strap portions 98*a*, 98*b*, respectively, to releasibly interconnect strap portions 94*a*, 94*b* and 98*a*, 98*b*, respectively. As shown by FIG. 4, connectors 96*a*, 96*b* each include interconnectable components 108 and 110. As best shown by FIG. 11, component 108 of connector 96*b* is attached to strap portion 94*b* while component 110 is secured to strap portion 98*b*. Connectors 96*a* are similarly configured. Components 108 and 110 are configured to interact with one another such that components 108 and 110 may be securely interconnected to one another to interconnect strap portions 94*a*, 94*b* to strap portion 98*a*, 98*b*, respectively, for compression or alternatively, to allow strap portions 94*a*, 94*b* to be separated from strap portions 98*a*, 98*b*, respectively, for expansion and unloading of main pack 20. As can be appreciated, a variety of releasable attachment mechanisms may be used to releasibly secure strap portions 94*a*, 94*b* to strap portions 98*a*, 98*b*, respectively.

Strap portions 98*a*, 98*b* are generally elongate strap-like mechanisms coupled between connectors 96*a*, 96*b*, respectively, and portions of main pack 22 proximate both back panel 36 and side panels 42, 44, respectively. Strap portions 98*b* preferably have opposite ends fixedly coupled to back panel proximate side panel 42 with connector 96*b* adjustably supported therebetween. Strap portions 98*a* are similarly configured.

Connectors 100*a*, 100*b* comprise conventionally known ladder locks coupled between strap portions 98*a*, 98*b*, respectively, and back panel 36. Connectors 100*a*, 100*b* are coupled to strap portions 98*a*, 98*b* and are configured to adjust the length of strap portions 98*a*, 98*b* so as to enable the user to adjust the degree that compression mechanisms 26, 28 compress main pack 20.

Figure 12:
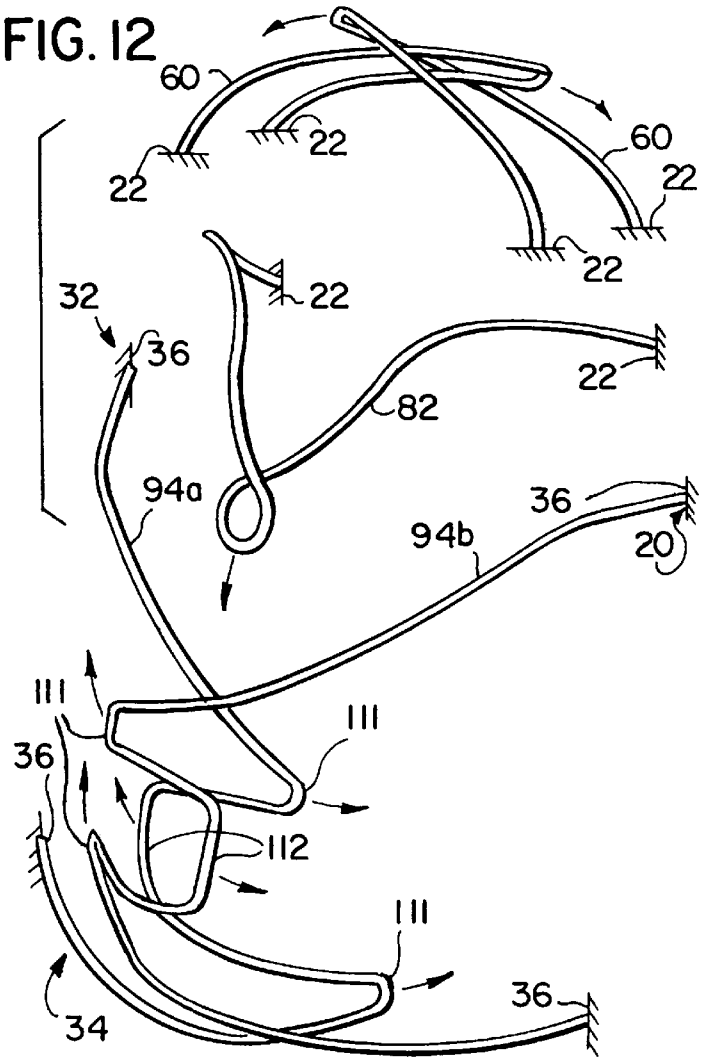
FIG. 12 is a perspective view illustrating portions of a compression mechanism of the pack compression system of FIGS. 1–11.

FIG. 12 is a perspective view illustrating the resulting forces applied to strap portions 60 of compression mechanisms 56, 58; strap portion 82 of compression mechanism 30 and strap portions 94*a*, 94*b* of compression mechanisms 26, 28. As shown by FIG. 12, strap portions 60 have ends which are fixedly secured to auxiliary pack 22 and overlap one another across auxiliary pack 22 to compress auxiliary pack 22. Strap portion 82 has ends fixedly secured to auxiliary pack 22 and is forced downward by buckle 86 (shown in FIG. 10) to downwardly compress the top 32 of main pack 20. Strap portions 94*a* and 94*b* have ends fixedly secured to back panel 36 of main pack 20 proximate top 32 and bottom end 34 of main pack 20. Strap portion 94*a* and 94*b* overlap one another between top 32 and bottom 34 of main pack 20 and have portions 111 which are pulled towards an opposite side of main pack 20 and portions 112 which are pulled toward the same side of main pack 20. Portions 111 and 112 preferably alternate along the length of strap portion 94*a* and 94*b*. As a result, each strap portion 94*a*, 94*b* compresses front panel 38 of main pack 20 towards back panel 36 of main pack 20. Strap portions 94*a*, 94*b* further compress panels 42 and 44 towards one another to symmetrically compress the contents of main pack 20.

Figure 13:
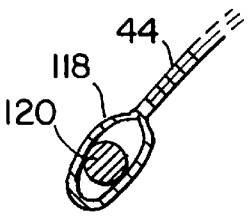
FIG. 13 is a fragmentary sectional view of the pack compression system of FIG. 10 taken along lines 13—13.

FIG. 13 is a cross-sectional view of panel 44 taken along lines 13—13 of FIG. 10. As best shown by FIG. 13, the perimeter of panel 44 includes an elongate sleeve 118 along its length which receives a substantially rigid mechanism 120. Mechanism 120 rigidifies the entire perimeter of panel 44. As a result, forces applied to portions of the perimeter of panel 44 are distributed along substantially the entire perimeter of panel 44 to evenly compress the entire panel 44 against the contents of main pack 20. As shown by FIG. 10, panel 42 is similarly constructed.

In the preferred embodiment illustrated, mechanism 120 preferably comprises an elongate rod made of Delrin. Alternatively, mechanism 120 can be formed from a variety of alternative materials which would substantially rigidify the perimeter of panels 42 and 44. These rigid materials may be integrally formed with or fixedly attached to and along the perimeters of panels 42 and 44 by various alternative methods in lieu of sleeve 118.

FIGS. 14 and 15 are cross sectional views of main pack 20 illustrating compression mechanisms 26, 28 being actuated to compress the contents of main pack 20. FIG. 14 illustrates main pack 20 in an expanded state while FIG. 15 illustrates main pack 20 in a compressed state. As best shown by FIGS. 14 and 15, main pack 20 is compressed by pulling strap portion 94*a* of compression mechanism 26 towards panel 44 across opening 48 in the direction indicated by arrow 124 and by also pulling strap portion 94*b* of compression mechanism 28 towards panel 42 across opening 48 in the direction indicated by arrow 126. As further shown by FIGS. 10 and 11, strap portions 94*a* and 94*b* are secured in place to strap portions 98*a*, 98*b* by connectors 96*a*, 96*b*, respectively. Because strap portions 98*a*, 98*b* are secured proximate to back panel 36, strap portions 94*a*, 94*b* are pulled both across opening 48 and towards back panel 36. As a result, the contents of main pack 20 are symmetrically compressed towards the longitudinal center line of main pack 20 between top 32 and bottom 34 and also towards back panel 36.

In addition to providing symmetrical compression of main pack 20, compression mechanisms 26 and 28 also relieve stresses exerted upon closing mechanisms 24 used to close opening 48. As shown by FIG. 15, because compression mechanisms 26 and 28 extend towards, and preferably across, opening 48, compression mechanisms 26 and 28 reduce tension within front panel 38 to further reduce stress applied to closing mechanisms 24. Consequently, the useful life of closing mechanisms 24 is prolonged. Moreover, opening 48 may be larger to provide accessibility to substantially the entire longitudinal length of main pack 20 between top 32 and bottom 34 without substantially increasing the potential for failure of closing mechanism 24. Because panels 42 and 44 have a length greater than the distance separating back panel 36 and front panel 38, panels 42 and 44 partially overlap front panel 38 upon compression of main pack 20. As a result, panels 42 and 44 also more effectively compress the contents of main pack 20 towards back panel 36.

Although pack compression system 10 is illustrated as utilizing side panels 42 and 44 for defining the interior of main pack 20 and also for compressing the interior of main pack 20 as a result of being connected to strap portions 94*a* and 94*b*, pack compression system 10 may alteratively include a first pair of side walls extending between back panel 36 and front panel 38 for defining the interior of main pack 20 and a second set of independent side panels coupled to main pack 20 proximate back panel 36 and connected to strap portions 94*a*, 94*b* for compressing the interior of main pack 20.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A pack compression system comprising:

a pack enclosing an internal volume, the pack having a top, a bottom, a back panel extending between the top and the bottom, and a front panel opposite the back panel, the front panel including a first opening longitudinally extending between the top and the bottom to access the internal volume, wherein the front panel is wider than the back panel;

a closing mechanism for selectively closing the opening; and first and second compression mechanisms coupled to the pack on opposite lateral sides of the opening, each compression mechanism extending from a first location proximate the back panel across the first opening to a second location proximate the back panel to compress the internal volume of the pack.

2. The compression system of claim 1, wherein first and second compression mechanisms include:

first and second side panels coupled to the back panel and extending toward the front panel; and first and second compression straps connected to the first and second panels extending across the first opening.

3. The compression system of claim 2, wherein the first and second side panels define the internal storage volume.

4. The compression system of claim 2, wherein the first and second side panels each have a rigid perimeter extending from the back panel.

5. The compression system of claim 4, wherein the first and second panels include a rigid mechanism extending along the perimeter.

6. The compression system of claim 2, wherein the first and second side panels have perimeters that are arcuate in shape.

7. The compression system of claim 2, wherein the first and second compression straps are coupled to the first and second side panels at a plurality of locations along a perimeter of each panel.

8. The compression system of claim 2, including a plurality of spaced loops coupled to the front panel and extending longitudinally between the top and the bottom; and a compression strap coupled to the back panel and including a connector to engage one of the plurality of loops to compress the top of the pack.

9. The compression system of claim 8, wherein the connector comprises a carabiner.

10. The compression system of claim 1, including a second opening extending through the top of the pack.

11. The compression system of claim 1, wherein the front panel is separated from the back panel by a first distance and wherein the first and second side panels extend from the back panel by a second greater distance such that the first and second panels partially overlap the front panel upon compression of the internal volume.

12. The compression system of claim 1, wherein the first opening is V-shaped.

13. The compression system of claim 1, wherein the first and second compression mechanisms overlap one another.

14. A pack compression system comprising:

a pack enclosing an internal volume, the pack having a top, a bottom, a back panel extending between the top and the bottom and configured for being positioned proximate the user's back, a front panel opposite the back panel, and first and second opposite side panels extending between the back panel and the front panel, the front panel including an opening to access the internal volume;

a first compression strap having a first end connected adjacent to the front panel and the first side panel of the pack and a second end connected adjacent to the back panel and the second side panel of the back, wherein the first compression strap extends across the opening to compress the internal storage volume of the pack; and a second compression strap having a first end connected adjacent to the front panel and the second side panel and a second end connected adjacent the back panel and the first side panel wherein the second compression strap extends across the opening to compress the internal storage volume of the pack.

15. The compression system of claim 14, including first and second flexible expansion panels extending between the front panel and the first and second side panels, respectively, the first and second expansion panels being moveable between a compact position in which the panels fold over the front panel and an expanded position in which the panels extend away from the front panel.

16. A pack compression system comprising:

a pack enclosing an internal volume, the pack having a top, a bottom, a back panel extending between the top and the bottom and configured for being positioned proximate the user's back, a front panel opposite the back panel, the pack including an opening to access the internal volume; and a first panel extending between the top and the bottom along a first side of the internal volume, the first panel being coupled proximate to the back panel and having a perimeter, the first panel extending towards the front panel;

a second panel extending between the top and the bottom along a second side of the internal volume, the second panel being coupled proximate to the back panel and having a perimeter, the second panel extending towards the front panel;

a first compression mechanism coupled to the perimeter of the first panel and configured for being releasibly coupled to the pack proximate the back panel and the second side of the internal volume to compress the first panel over the internal volume and towards the second side of the internal volume; and a second compression mechanism attached to the perimeter of the second panel and configured for being releasibly coupled to the pack proximate the back panel and the first side of the internal volume to compress the second panel over the front panel and towards the first side of the internal volume.

17. The compression system of claim 16, wherein the front panel includes the opening, wherein the opening longitudinally extends between the top and the bottom and wherein the first and second compression mechanisms extend across the opening while compressing the internal volume of the pack.

18. The compression system of claim 16, wherein the front panel includes the opening, wherein the opening longitudinally extends between the top and the bottom and wherein the first and second panels extend across the opening while compressing the internal volume of the pack.

19. The compression system of claim 16, wherein the perimeter of the first and second panels is substantially rigid.

20. The compression system of claim 16, wherein the first and second panels extend beyond the front panel.

21. A pack compression system comprising:

a pack enclosing an internal volume;

first and second spaced connector points at first and second locations on the pack;

a first compression mechanism having first and second spaced portions, the first portion secured to a third location of the pack; and a first connector secured to the second portion of the first compression mechanism and configured for releasibly connecting the second portion to either of the first and second connector points to adjust compression of the internal volume by the first compression mechanism.

22. The compression system of claim 21, wherein the pack includes a top and a bottom and wherein the first connector point is closer to the top than the second connector point.

23. The compression system of claim 21, wherein the first and second connector points comprise first and second spaced loops attached to the pack.

24. The compression system of claim 21, wherein the pack includes a back panel and a front panel opposite back panel, wherein the first and second spaced connector points extend along the front panel and wherein the first portion of the first compression mechanism is secured to the back panel.

25. The compression system of claim 21, including:

a second compression mechanism having third and fourth spaced portions, the third portion secured to a fourth location on the pack; and a second connector secured to the fourth portion of the second compression mechanism and configured for releasibly connecting the fourth portion to either of the first and second connector points to adjust compression of the internal volume by the second compression mechanism.

26. The compression system of claim 25, wherein the pack includes a top, a bottom, the back panel extending between the top and the bottom, and a front panel opposite the back panel, wherein the first portion of the first compression mechanism is secured to the back panel proximate the top of the pack and wherein the third portion of the second compression mechanism is secured to the back panel proximate the bottom of the pack.

27. The compression system of claim 21, including an adjustable buckle and wherein the first compression mechanism includes a strap portion extending through the adjustable buckle to enable spacing between the first and second portions to be adjusted.

28. The compression system of claim 21, wherein the first and second spaced connector points comprise a daisy chain and wherein the first connector comprises a carabiner.

29. A receptacle compression system comprising:

a receptacle enclosing an internal volume, the pack having a top, a bottom, a back panel extending between the top and the bottom, and a front panel opposite the back panel, the front panel including a first opening longitudinally extending between the top and the bottom to access the internal volume;

a closing mechanism for selectively closing the opening; and first and second compression mechanisms coupled to the pack on opposite lateral sides of the first opening, each compression mechanism extending from a first location proximate the back panel across the first opening to a second location proximate the back panel to compress the internal volume of the receptacle, wherein first and second compression mechanisms include:

first and second side panels coupled to the back panel and extending toward the front panel, wherein the first and second side panels each have a rigid perimeter extending from the back panel; and first and second compression straps connected to the first and second panels and extending across the first opening.

30. A receptacle compression system comprising:

a receptacle enclosing an internal volume, the receptacle having a top, a bottom, a back panel extending between the top and the bottom, and a front panel opposite the back panel, the front panel including a first opening longitudinally extending between the top and the bottom to access the internal volume;

a closing mechanism for selectively closing the first opening; and first and second compression mechanisms coupled to the receptacle on opposite lateral sides of the opening, each compression mechanism extending from a first location proximate the back panel across the first opening to a second location proximate the back panel to compress the internal volume of the receptacle, wherein first and second compression mechanisms include:

first and second side panels coupled to the back panel and extending toward the front panel; and first and second compression straps connected to the first and second panels and extending across the first opening, wherein the first and second compression straps are coupled to the first and second panels at a plurality of locations along a perimeter of each panel.

31. A pack compression system comprising:

a pack enclosing an internal volume, the pack having a top, a bottom, a back panel extending between the top and the bottom, and a front panel opposite the back panel, the front panel including a first opening longitudinally extending between the top and the bottom to access the internal volume, and a second opening extending through the top of the pack;

a closing mechanism for selectively closing the opening; and first and second compression mechanisms coupled to the pack on opposite lateral sides of the opening, each compression mechanism extending from a first location proximate the back panel across the first opening to a second location proximate the back panel to compress the internal volume of the pack.

32. A load support system comprising:

a frame;

a pair of shoulder supports coupled to the frame and configured to extend about a user's shoulders;

a belt coupled to the frame and configured to extend about a user's waist;

a pack enclosing an internal volume, the pack having a top, a bottom, a back panel extending between the top and the bottom adjacent to the frame, and a front panel opposite the back panel, the front panel including an opening longitudinally extending between the top and the bottom to access the internal volume;

a closing mechanism for selectively closing the opening; and first and second compression mechanisms coupled to the pack on opposite lateral sides of the opening, each compression mechanism extending from a first location proximate the back panel across the opening to a second location proximate the back panel to compress the internal volume of the pack.

* * * * *